US010943520B2

(12) United States Patent
Shu et al.

(10) Patent No.: US 10,943,520 B2
(45) Date of Patent: Mar. 9, 2021

(54) DISPLAY METHOD OF DISPLAY PANEL, DRIVE CIRCUIT, DISPLAY DEVICE AND COMPUTER-READABLE STORAGE MEDIUM

(71) Applicants: BEIJING BOE OPTOELECTRONICS TECHNOLOGY CO., LTD., Beijing (CN); BOE TECHNOLOGY GROUP CO., LTD., Beijing (CN)

(72) Inventors: Xingjun Shu, Beijing (CN); Xi Chen, Beijing (CN); Yafeng Wang, Beijing (CN); Yanming Wang, Beijing (CN); Lidong Wang, Beijing (CN); Zhengxuan Lv, Beijing (CN); Zongli Gao, Beijing (CN); Junjie Xu, Beijing (CN); Bing Xia, Beijing (CN); Qi Zhang, Beijing (CN); Jingfei Mu, Beijing (CN); Dawei Wang, Beijing (CN)

(73) Assignees: Beijing BOE Optoelectronics Technology Co., Ltd., Beijing (CN); BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 16/491,089

(22) PCT Filed: Mar. 19, 2019

(86) PCT No.: PCT/CN2019/078709

§ 371 (c)(1),
(2) Date: Sep. 4, 2019

(87) PCT Pub. No.: WO2019/201046

PCT Pub. Date: Oct. 24, 2019

(65) Prior Publication Data

US 2020/0402439 A1 Dec. 24, 2020

(30) Foreign Application Priority Data

Apr. 19, 2018 (CN) ..... 201810355380.9

(51) Int. Cl.
*G09G 3/20* (2006.01)

(52) U.S. Cl.
CPC ... *G09G 3/2003* (2013.01); *G09G 2300/0452* (2013.01); *G09G 2310/0275* (2013.01)

(58) Field of Classification Search
CPC .. G09G 3/3611; G09G 3/3225; G09G 3/3283; G09G 3/3607; G02F 1/133512;
(Continued)

(56) References Cited

U.S. PATENT DOCUMENTS

2010/0289994 A1* 11/2010 Nonaka ..... G09G 3/20 349/108
2016/0178940 A1* 6/2016 Yuan ..... G02F 1/133512 359/893

(Continued)

FOREIGN PATENT DOCUMENTS

CN 101887189 A 11/2010
CN 104809980 A 7/2015

(Continued)

OTHER PUBLICATIONS

First Office Action for CN 201810355380.9 dated Dec. 25, 2019, 24 pages with English translation.

*Primary Examiner* — Sepehr Azari
(74) *Attorney, Agent, or Firm* — The Webb Law Firm

(57) ABSTRACT

The present invention provides a display method of a display panel, a drive circuit, a display device and a computer-readable storage medium. The method comprises: acquiring remaining ratios of subpixels of respective colors in each irregular pixel, the remaining ratio being a ratio of the opening area of the subpixel in the irregular pixel and the (Continued)

opening area of the subpixel of the same color in the regular pixel; determining actual light intensities of respective subpixels in each irregular pixel according to remaining ratios and corresponding original light intensities of the respective subpixels; causing respective subpixels in each irregular pixel to display corresponding actual light intensities.

9 Claims, 2 Drawing Sheets

(58) Field of Classification Search
CPC ..... G02F 1/133514; H01L 51/5281; H01L 27/3272; H01L 27/3211
See application file for complete search history.

(56) References Cited

U.S. PATENT DOCUMENTS

2016/0267847 A1* 9/2016 Chen ..... G09G 3/3225
2019/0073968 A1* 3/2019 Tominaga ..... G09G 3/3607
2019/0088709 A1* 3/2019 Zeng ..... H01L 27/1218
2019/0140026 A1* 5/2019 Nakanishi ..... H01L 51/50
2019/0164510 A1* 5/2019 Fang ..... G09G 3/3611

FOREIGN PATENT DOCUMENTS

CN 105511152 A 4/2016
CN 105911744 A 8/2016
CN 106033656 A 10/2016
CN 106707606 A 5/2017
CN 107167957 A 9/2017
CN 107255884 A 10/2017
CN 107357066 A 11/2017
CN 107479269 A 12/2017
CN 108520715 A 9/2018
JP 2006-276580 A 10/2006

* cited by examiner

DISPLAY METHOD OF DISPLAY PANEL, DRIVE CIRCUIT, DISPLAY DEVICE AND COMPUTER-READABLE STORAGE MEDIUM

CROSS-REFERENCE TO RELATED APPLICATIONS

This application is a U.S. National Stage under 35 U.S.C. § 371 of International Application No. PCT/CN2019/078709, as filed on Mar. 19, 2019, which claims priority to Chinese Patent Application No. 201810355380.9, as filed on Apr. 19, 2018, and entitled "DISPLAY METHOD OF DISPLAY PANEL, DRIVE CIRCUIT, AND DISPLAY DEVICE". The disclosure of each of these applications is incorporated by reference herein for all purposes.

TECHNICAL FIELD

The present disclosure relates to a display method of a display panel, a drive circuit of a display panel, a display device and a computer-readable storage medium.

SUMMARY

According to a first aspect of the present disclosure, there is provided a display method of a display panel, the display panel includes multiple regular pixels and at least one irregular pixel, each pixel includes multiple subpixels of different colors, opening areas of subpixels of a same color in respective regular pixels are the same, an opening area of at least one subpixel in each irregular pixel is different from that of a subpixel of the same color in the regular pixel, the method comprises:

acquiring remaining ratios of subpixels of respective colors in each irregular pixel, the remaining ratio being a ratio of the opening area of the subpixel in the irregular pixel and the opening area of the subpixel of the same color in the regular pixel;

determining actual light intensities of respective subpixels in each irregular pixel according to remaining ratios and corresponding original light intensities of the respective subpixels, wherein, when respective subpixels of any one irregular pixel display according to corresponding actual light intensities, a ratio of light fluxes of respective subpixels thereof is equal to a desired ratio of light fluxes, the desired ratio of light fluxes is a ratio of light fluxes when respective subpixels in the regular pixel display according to original light intensities of corresponding respective subpixels in the regular pixel;

causing respective subpixels in each irregular pixel to display corresponding actual light intensities.

Optionally, determining actual light intensities of respective subpixels in each irregular pixel according to remaining ratios and corresponding original light intensities of the respective subpixels comprises:

using the light intensity obtained by dividing the original light intensity of each subpixel in the irregular pixel by the corresponding remaining ratio as the actual light intensity of the corresponding subpixel.

Optionally, determining actual light intensities of respective subpixels in each irregular pixel according to remaining ratios and corresponding original light intensities of the respective subpixels comprises:

determining a minimum value of remaining ratios of respective subpixels in each irregular pixel;

using the light intensity obtained by dividing the original light intensity of each subpixel in each irregular pixel by its remaining ratio and multiplying it by the minimum remaining ratio in the irregular pixel as the actual light intensity of the corresponding subpixel.

Optionally, determining actual light intensities of respective subpixels in each irregular pixel according to remaining ratios and corresponding original light intensities of the respective subpixels comprises:

determining a maximum value of remaining ratios of respective subpixels in each irregular pixel;

using the light intensity obtained by dividing the original light intensity of each subpixel in each irregular pixel by its remaining ratio and multiplying it by the maximum remaining ratio in the irregular pixel as the actual light intensity of the corresponding subpixel.

Optionally, determining actual light intensities of respective subpixels in each irregular pixel according to remaining ratios and corresponding original light intensities of the respective subpixels comprises:

determining an average value of remaining ratios of respective subpixels in each irregular pixel;

using the light intensity obtained by dividing the original light intensity of each subpixel in each irregular pixel by its remaining ratio and multiplying it by the average remaining ratio in the irregular pixel as the actual light intensity of the corresponding subpixel.

Optionally, the display panel includes at least one irregular pixel group, each group has at least two irregular pixels, Between determine the actual light intensities of respective subpixels in each irregular pixel and causing each irregular pixel to display the corresponding actual light intensity, the method further comprises:

detecting, when respective subpixels in respective irregular pixels display according to the current actual light intensities, whether a light flux difference between any two irregular pixels in each irregular pixel group exceeds a predetermined value, and if the light flux difference exceeds the predetermined value, adjusting the actual light intensities of respective subpixels of at least one irregular pixel in a same proportion, so that, when respective subpixels in respective irregular pixels display according to the adjusted actual light intensities, the light flux difference between any two irregular pixels in each irregular pixel group is within the predetermined value.

Optionally, causing respective subpixels in each irregular pixel to display corresponding actual light intensities comprises:

obtaining data voltages corresponding to the actual light intensities of respective subpixels in each irregular pixel, and providing the corresponding data voltages to respective subpixels, to cause respective subpixels to display the corresponding actual light intensities.

According to a second aspect of the present disclosure, there is provided a drive circuit of a display panel comprising a memory and a processor, the memory stores instructions, the processor runs the instructions to execute the method provided according to a first aspect of the present disclosure.

According to a third aspect of the present disclosure, there is provided a display device comprising a display panel, the display panel includes multiple regular pixels and at least one irregular pixel, each pixel includes multiple subpixels of different colors, opening areas of subpixels of a same color in respective regular pixels are the same, an opening area of at least one subpixel in each irregular pixel is different from that of a subpixel of the same color in the regular pixel, the display device further comprises a drive circuit for the display panel, the drive circuit is the drive circuit provided according to a second aspect of the present disclosure.

Optionally, the display device is a cellphone.

According to a fourth aspect of the present disclosure, there is provided a computer-readable storage medium with computer-readable program instructions stored thereon which, when executed by a processor, cause the processor to perform the method as described above.

BRIEF DESCRIPTION OF THE DRAWINGS

The drawings are used to provide further understanding of the present disclosure, and form a part of the specification, and are used to explain the present disclosure together with the following DETAILED DESCRIPTION, and do not constitute limitations to the present disclosure. In the drawings.

DETAILED DESCRIPTION

Hereinafter, in conjunction with the drawings, specific embodiments of the present disclosure are explained in detail. It should be understood that, specific embodiments described herein are only for illustrating and explaining the present disclosure, and not to limit the present disclosure.

Figure 1:
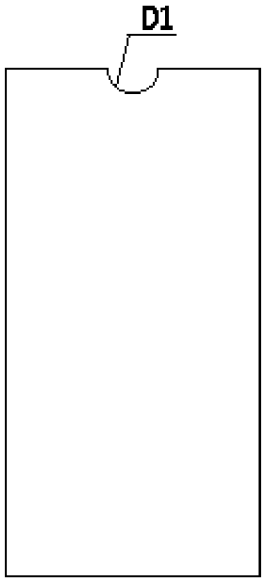
FIG. 1 is a schematic view of a display region of an exemplary irregular display panel.

An appearance of a screen of an exemplified irregular display is as shown in FIG. 1. In most regions of the screen, opening areas of subpixels of a same color in respective pixels are the same, i.e., most pixels are regular pixels. But, most of pixels at an irregular boundary D1 of the screen are irregular pixels. This is because, pixels in a region above the irregular boundary D1 of the screen are entirely or partially shielded by a black matrix. In some embodiments, the irregular pixel also includes a pixel which itself is irregular. Taking opening areas of respective subpixels of the regular pixel being the same as an example, an opening area of a green subpixel G in an irregular pixel shown in FIG. 2(*a*) is reduced by a half. Generally, display data for driving a display panel regards the display panel as a regular panel by default, and when such display data is used to drive the irregular display panel such as shown in FIG. 1, a light intensity displayed at each subpixel of the irregular pixel at the irregular boundary D1 is still a light intensity which the display data desires (i.e., energy of light within a unit area), this desired light intensity corresponds to an opening area of a corresponding subpixel of the regular pixel. However, since an opening area of at least one subpixel in the irregular pixel is reduced to different degrees, this causes a ratio of light fluxes (i.e., a product of the light intensity and the opening area) emitted by respective subpixels in the irregular pixel to be not a desired ratio of light fluxes, so that a color of light emitted by the irregular pixel distorts (i.e., a ratio of colors of respective subpixels therein changes, so that the whole "color" changes, this is not a change in the luminance).

The present disclosure provides a display method of a display panel, a drive circuit of a display panel, a display device, and a computer-readable storage medium, to avoid distortion of colors of pixels at an irregular boundary of an irregular display panel.

According to the method provided by an embodiment of the present disclosure, by adjusting a light intensity of each subpixel in an irregular pixel so that a ratio of light fluxes of these subpixels still maintains to be a desired ratio of light fluxes, it is possible to cause a color of light emitted by a pixel at an irregular boundary not to distort.

According to a first aspect of the present disclosure, there is provided a display method of a display panel, the display panel includes multiple regular pixels and at least one irregular pixel, each pixel includes multiple subpixels of different colors, opening areas of subpixels of a same color in respective regular pixels are the same, an opening area of at least one subpixel in each irregular pixel is different from that of a subpixel of the same color in the regular pixel.

That is, the display panel includes multiple pixels, each pixel consists of multiple subpixels (such as subpixels of three colors of red, green, blue), and these pixels are divided into irregular pixels and regular pixels, wherein, corresponding subpixels in respective regular pixels are the same, whereas with respect to the irregular pixels, at least some subpixels therein have a part thereof "cut off (such as shielded by the black matrix)", therefore the opening areas of these subpixels are smaller than those of corresponding normal subpixels in the regular pixels.

Figure 3:
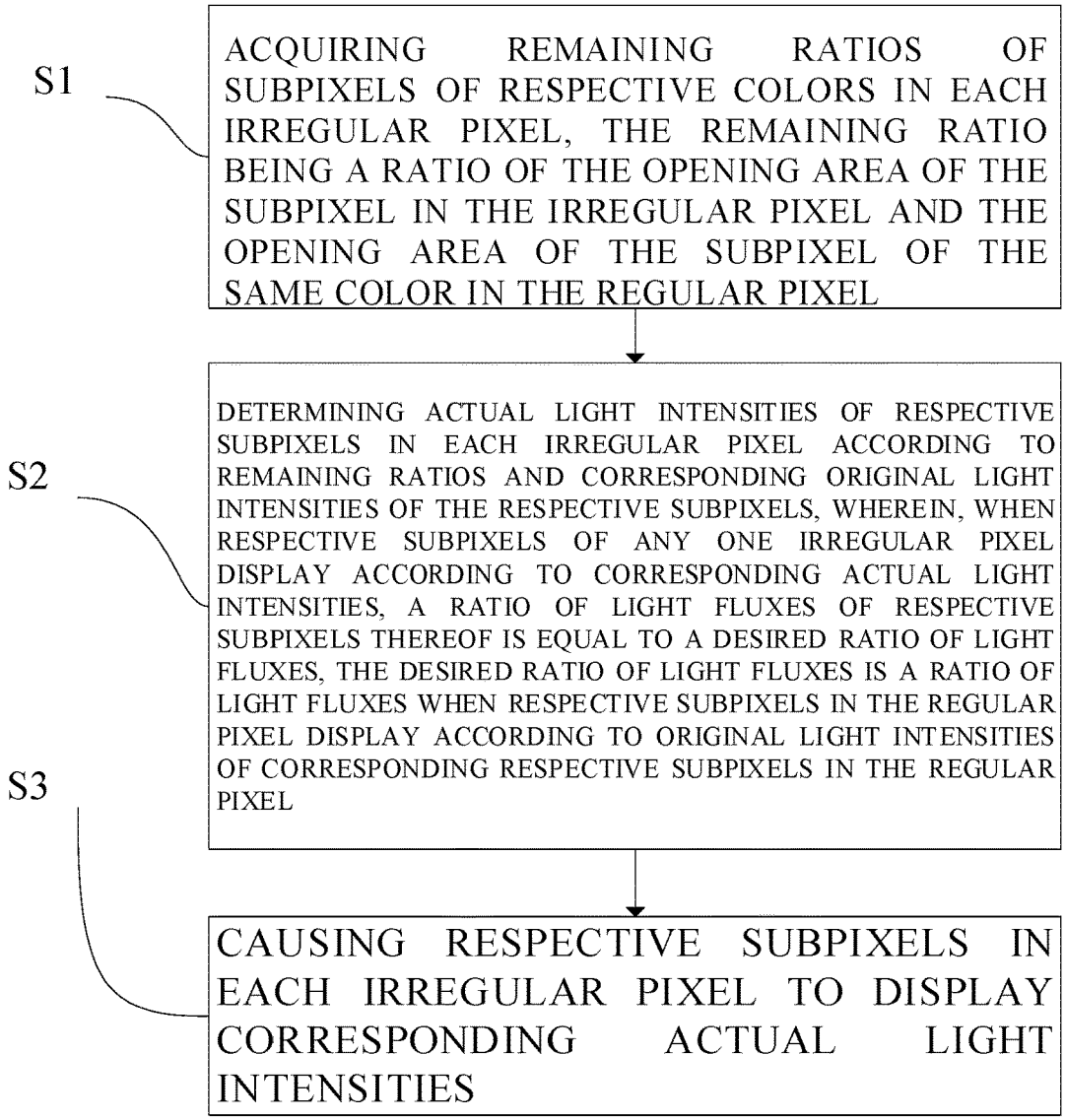
FIG. 3 is a flow chart of a display method of a display panel provided by an embodiment of the present disclosure.

As shown in FIG. 3, the method includes:

step S1: acquiring remaining ratios of subpixels of respective colors in each irregular pixel, the remaining ratio being a ratio of the opening area of the subpixel in the irregular pixel and the opening area of the subpixel of the same color in the regular pixel.

With respect to a display panel of a certain model, information of whether each pixel being an irregular pixel, as well as remaining ratios of respective subpixels in each irregular pixel, as well as a position of each irregular pixel in the display panel, is determinate. When this step is executed, it is necessary to acquire these pieces of information.

The remaining ratios of subpixels of respective colors in each irregular pixel may be any one numerical value which is more than 0 and less than or equal to 1 (when the remaining ratio is equal to 1, this means that the opening area of the subpixel is equal to the opening area of the subpixel of the same color in the regular pixel), but at least one remaining ratio among them is less than 1. I.e., the present disclosure does not involve a case where the remaining ratio of a certain subpixel is 0, because, when the remaining ratio is 0, it means that the subpixel "does not exist", therefore naturally computation will not be performed on it.

Figure 2A:
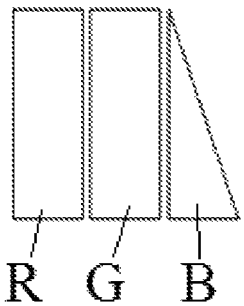
FIG. 2(*a*)-FIG. 2(*c*) are examples of three cases of opening areas of subpixels of respective colors of an irregular pixel in an embodiment of the present disclosure.
Figure 2B:
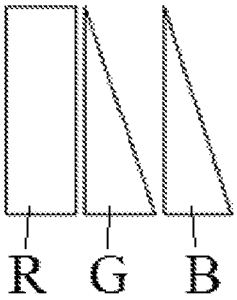
Figure 2C:
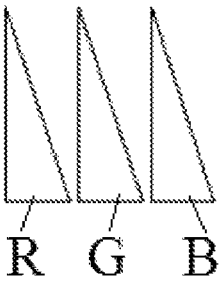

For example, remaining ratios of subpixels R, G, B of three colors of red, green, blue in the irregular pixel in FIG. 2(*a*) are 1, 1, 0.5 in order; remaining ratios of subpixels R, G, B of three colors of red, green, blue in the irregular pixel in FIG. 2(*b*) are 1, 0.5, 0.5 in order; remaining ratios of subpixels R, G, B of three colors of red, green, blue in the irregular pixel in FIG. 2(*c*) are 0.5, 0.5, 0.5 in order.

step S2: determining actual light intensities of respective subpixels in each irregular pixel according to remaining ratios and corresponding original light intensities of the respective subpixels, wherein, when respective subpixels of any one irregular pixel display according to corresponding actual light intensities, a ratio of light fluxes of respective subpixels thereof is equal to a desired ratio of light fluxes, the desired ratio of light fluxes is a ratio of light fluxes when respective subpixels in the regular pixel display according to original light intensities of corresponding respective subpixels in the regular pixel.

The original light intensity of each subpixel is an light intensity corresponding to original display data of each subpixel. Taking an liquid crystal display panel as an example, original display data is input to a Source IC, so the Source IC will drive subpixels in each pixel in the liquid crystal panel in accordance with this original display data to emit light of a corresponding light intensity.

Generally, the original display data regards the display panel as having no irregular pixel by default. If original display data is not modified, light fluxes emitted by respective subpixels in the irregular pixel are not desired light fluxes, the ratio of light fluxes of light emitted by respective subpixels in the irregular pixel is not the desired ratio of light fluxes either. This causes the color displayed by the irregular pixel to distort.

When light intensities of respective subpixels in each irregular pixel are modified, the ratio of light fluxes of respective subpixels in each irregular pixel after the modification should maintain to be the ratio of light fluxes desired by original display data.

Taking the irregular pixel shown in FIG. 2(*a*) as an example, a case where a normally displayed brightest grey scale is L255 is explained. Original display data desires the irregular pixel to display a pure white color with a grey scale L255, light intensities of subpixels R, G, B of three colors are R1, G1, B1, respectively, light fluxes of subpixels R, G, B of three colors are R2, G2, B2, respectively. In a case where a margin of the light intensity which may be displayed by the display panel is big enough, it is possible to increase the actual light intensity of the blue subpixel B to be twice as large as the original light intensity B1. Or, it is also possible to decrease the actual light intensities of the red subpixel R and the green subpixel G to be 50% of the original light intensities, then at this time, the ratio of light fluxes of each subpixel of the irregular pixel is still the desired ratio of light fluxes, the color displayed by the irregular pixel does not distort. Hereinafter, several methods of determining the light intensity of the irregular pixel are listed.

Optionally, as some embodiments of the present disclosure, determining actual light intensities of respective subpixels in each irregular pixel according to remaining ratios and corresponding original light intensities of the respective subpixels comprises: using the light intensity obtained by dividing the original light intensity of each subpixel in the irregular pixel by the corresponding remaining ratio as the actual light intensity of the corresponding subpixel.

That is, the light intensities of respective subpixels in the irregular pixel increase accordingly according to proportions of reduction of the opening areas thereof, so that the color and the luminance of the light emitted by the irregular pixel still maintain to be the desired color and luminance.

Taking the irregular pixel shown in FIG. 2(*a*) as an example, the actual light intensities of the red subpixel R and the green subpixel G are corresponding original light intensities, the actual light intensity of the blue subpixel B is twice as large as the corresponding original light intensity.

Optionally, as some other embodiments of the present disclosure, determining actual light intensities of respective subpixels in each irregular pixel according to remaining ratios and corresponding original light intensities of the respective subpixels comprises: determining a minimum value of remaining ratios of respective subpixels in each irregular pixel; using the light intensity obtained by dividing the original light intensity of each subpixel in each irregular pixel by its remaining ratio and multiplying it by the minimum remaining ratio in the irregular pixel as the actual light intensity of the corresponding subpixel.

That is, the light intensity of the light emitted by the subpixel with the minimum remaining ratio in the irregular pixel does not change, the light intensities of the light emitted by the remaining subpixels are appropriately decreased, so that this guarantees that the color of light emitted by the irregular pixel does not change, but there is some loss in the luminance.

Taking the irregular pixel shown in FIG. 2(*a*) as an example, the minimum remaining ratio is 50%, the actual light intensities of the red subpixel R and the green subpixel G are 50% of corresponding original light intensities, the actual light intensity of the blue subpixel B is the corresponding original light intensity.

Optionally, as some other embodiments of the present disclosure, determining actual light intensities of respective subpixels in each irregular pixel according to remaining ratios and corresponding original light intensities of the respective subpixels comprises: determining a maximum value of remaining ratios of respective subpixels in each irregular pixel; using the light intensity obtained by dividing the original light intensity of each subpixel in each irregular pixel by its remaining ratio and multiplying it by the maximum remaining ratio in the irregular pixel as the actual light intensity of the corresponding subpixel.

That is, the light intensity of the light emitted by the subpixel with the maximum remaining ratio in the irregular pixel does not change, the light intensities of the light emitted by the remaining subpixels are appropriately increased, so that this guarantees that the color of light emitted by the irregular pixel does not change, but there is some improvement in the luminance or the luminance does not change.

Taking the irregular pixel shown in FIG. 2(*a*) as an example, the maximum remaining ratio is 100%, the actual light intensities of the red subpixel R and the green subpixel G are corresponding original light intensities, the actual light intensity the blue subpixel B is twice as large as the corresponding original light intensity.

Optionally, as some other embodiments of the present disclosure, determining actual light intensities of respective subpixels in each irregular pixel according to remaining ratios and corresponding original light intensities of the respective subpixels comprises: determining an average value of remaining ratios of respective subpixels in each irregular pixel; using the light intensity obtained by dividing the original light intensity of each subpixel in each irregular pixel by its remaining ratio and multiplying it by the average remaining ratio in the irregular pixel as the actual light intensity of the corresponding subpixel.

That is, the light intensity of the light emitted by the subpixel with the average remaining ratio in the irregular pixel substantially does not change, the light intensities of the light emitted by the subpixels with larger remaining ratios are appropriately decreased, the light intensities of the light emitted by the subpixels with smaller remaining ratios are appropriately increased, so that this guarantees that the color of light emitted by the irregular pixel does not change.

Taking the irregular pixel shown in FIG. 2(*b*) as an example, the average remaining ratio is 66.66%, the actual light intensity of the red subpixel R is 66.66% of the corresponding original light intensity, the actual light intensities of the blue subpixel B and the green subpixel G are 133.33% of corresponding original light intensities.

Optionally, the display panel includes at least one irregular pixel group, each group has at least two irregular pixels.

Between determine the actual light intensities of respective subpixels in each irregular pixel and causing each irregular pixel to display the corresponding actual light intensity, the method further comprises:

detecting, when respective subpixels in respective irregular pixels display according to the current actual light intensities, whether a light flux difference between any two irregular pixels in each irregular pixel group exceeds a predetermined value, and if the light flux difference exceeds the predetermined value, adjusting the actual light intensities of respective subpixels of at least one irregular pixel in a same proportion, so that, when respective subpixels in respective irregular pixels display according to the adjusted actual light intensities, the light flux difference between any two irregular pixels in each irregular pixel group is within the predetermined value.

That is, the display panel may have multiple irregular pixels, and these irregular pixels are arranged to be adjacent (such as the multiple irregular pixels arranged along the irregular boundary D1 in FIG. 1). And those skilled in the art may regard multiple irregular pixels within a certain region as one group, sometimes this group may also include a certain number of regular pixels. Irregular pixels within a group are relatively adjacent.

Generally, the color and the luminance of the image displayed near the irregular boundary change gradually, and there is no case where the light flux difference of the adjacent pixels is too big. If, after determining the actual light intensities of the adjacent irregular pixels, the light flux difference between them is found to be too big, it is necessary to increase or decrease their light fluxes in a proportion, and accordingly, each subpixel in the irregular pixel which needs to be adjusted is adjusted in the same proportion.

step S3: causing respective subpixels in each irregular pixel to display corresponding actual light intensities.

After determining the actual light intensities of respective subpixels in each irregular pixel, it is possible to, according to a display mechanism of the display panel, modify corresponding display data, drive the display panel to display according to the modified display data.

According to the method provided by the embodiment, it guarantees that the color displayed by each irregular pixel does not distort. Therefore, abnormal display of colors which occurs at the irregular boundary of the irregular display panel is avoided.

Wherein, if the light intensities of the subpixels of the irregular pixel have been adjusted, this step is the subpixels of the irregular pixel displaying according to the adjusted light intensities.

Optionally, causing respective subpixels in each irregular pixel to display corresponding actual light intensities comprises: obtaining data voltages corresponding to the actual light intensities of respective subpixels in each irregular pixel, and providing the corresponding data voltages to respective subpixels, to cause respective subpixels to display the corresponding actual light intensities.

With respect to the liquid crystal display panel, the data voltage corresponds to a voltage which is applied to two poles of a capacitor formed on a liquid crystal box in the liquid crystal display panel.

With respect to an organic light-emitting diode (OLED) display panel, the data voltage corresponds to a gate voltage of a drive transistor which provides drive current to each diode in the OLED display panel.

The actual light intensities are determined according to the method provided by an embodiment of the present disclosure, and further the data voltages are determined according to the actual light intensities, and finally, with respect to the image displayed by the entire display panel, color distortion will not occur to respective irregular pixels at the irregular boundary.

Figure 4:
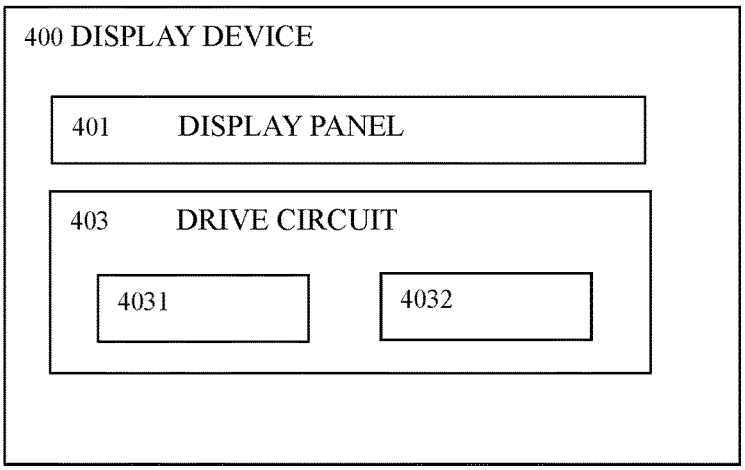
FIG. 4 is a schematic view of a display device provided by an embodiment of the present disclosure.

FIG. 4 illustrates an exemplary structure diagram of a display device 400 according to an embodiment of the present disclosure. As shown in FIG. 4, the display device 400 includes a display panel 401 and a drive circuit 403.

As described before, the display panel 401 may include multiple regular pixels and at least one irregular pixel (e.g., those shown in FIGS. 2(*a*), 2(*b*), 2(*c*)), each pixel includes multiple subpixels of different colors, opening areas of subpixels of a same color in respective regular pixels are the same, an opening area of at least one subpixel in each irregular pixel is different from that of a subpixel of the same color in the regular pixel.

The drive circuit 403 is used to drive the display panel 401, it includes a memory 4031 and a processor 4033. The memory 4031 stores instructions which, when the processor 4033 runs the instructions, cause the processor to execute the method as described before according to the present disclosure.

The memory 4031 includes, but not limited to, a volatile storage medium (e.g., a random read-write memory including a static random memory and a dynamic random memory) and a nonvolatile memory (e.g., a read-only memory, including EPROM, EEPROM, etc).

The display device 400 includes various electronic apparatuses which have a display function, including but not limited to, a tablet computer, a desktop computer, a game machine, a television, a cellphone, a pad, etc.

According to some embodiments, the display device is a cellphone. In the cellphone, in view of setting a microphone, a camera, etc, many display panels of the cellphones are irregular, therefore the irregular pixels exist in the cellphones more often.

It may be understood that the above embodiments are only exemplary embodiments adopted to explain the principles of the present disclosure, but the present disclosure is not limited thereto. To those ordinary skilled in the art, various modifications and improvements may be made without departing from the spirit and the essence of the present disclosure, these modifications and improvements are also considered to be within the protection scope of the present disclosure.

What is claimed is:

1. A display method of a display panel, the display panel including multiple regular pixels and at least one irregular pixel, each pixel including multiple subpixels of different colors, opening areas of subpixels of a same color in respective regular pixels being the same, an opening area of at least one subpixel in each irregular pixel being different from that of a subpixel of a same color in the regular pixel, the display method comprising: acquiring remaining ratios of respective subpixels in each irregular pixel, a remaining ratio being a ratio of an opening area of a subpixel in the irregular pixel and an opening area of a subpixel of a same color in the regular pixel;

determining actual light intensities of the respective subpixels in each irregular pixel according to the remaining ratios and corresponding original light intensities of the respective subpixels, wherein when the respective subpixels of any one irregular pixel display according to corresponding actual light intensities, a ratio of light fluxes of the respective subpixels of the irregular pixel is equal to a desired ratio of light fluxes, the desired ratio of light fluxes is a ratio of light fluxes when the respective subpixels in a regular pixel display according to original light intensities of corresponding the respective subpixels in the regular pixel; causing the respective subpixels in each irregular pixel to display the corresponding actual light intensities;

wherein determining the actual light intensities of the respective subpixels in each irregular pixel according to the remaining ratios and the corresponding original light intensities of the respective subpixels further comprises one of the following:

(1) determining a minimum remaining ratio of remaining ratios of respective subpixels in each irregular pixel, and using the light intensity obtained by dividing the original light intensity of each subpixel in each irregular pixel by a corresponding remaining ratio of the subpixel and multiplying it by the minimum remaining ratio in the irregular pixel as the actual light intensity of the subpixel;

(2) determining a maximum remaining ratio of remaining ratios of respective subpixels in each irregular pixel, and using the light intensity obtained by dividing the original light intensity of each subpixel in each irregular pixel by a corresponding remaining ratio of the subpixel and multiplying it by the maximum remaining ratio in the irregular pixel as the actual light intensity of the subpixel; or (3) determining an average remaining ratio of remaining ratios of respective subpixels in each irregular pixel, and using the light intensity obtained by dividing the original light intensity of each subpixel in each irregular pixel by a corresponding remaining ratio of the subpixel and multiplying it by the average remaining ratio in the irregular pixel as the actual light intensity of the subpixel.

2. The display method according to claim 1, wherein the display panel includes at least one irregular pixel group, each group has at least two irregular pixels, between determining the actual light intensities of respective subpixels in each irregular pixel and causing each irregular pixel to display the corresponding actual light intensity, the display method further comprises:

detecting, when respective subpixels in respective irregular pixels display according to current actual light intensities, whether a light flux difference between any two irregular pixels in each irregular pixel group exceeds a predetermined value, and if the light flux difference exceeds the predetermined value, adjusting the actual light intensities of respective subpixels of at least one irregular pixel in a same proportion, so that, when respective subpixels in respective irregular pixels display according to the adjusted actual light intensities, the light flux difference between any two irregular pixels in each irregular pixel group is within the predetermined value.

3. The display method according to claim 1, wherein causing the respective subpixels in each irregular pixel to display the corresponding actual light intensities further comprises:

obtaining data voltages corresponding to the actual light intensities of respective subpixels in each irregular pixel, and providing the corresponding data voltages to respective subpixels, to cause respective subpixels to display corresponding actual light intensities.

4. A drive circuit of a display panel comprising a memory and a processor, wherein the memory stores instructions, the processor runs the instructions to execute the display method according to claim 1.

5. A display device comprising a display panel, the display panel including multiple regular pixels and at least one irregular pixel, each pixel including multiple subpixels of different colors, opening areas of subpixels of a same color in respective regular pixels being the same, an opening area of at least one subpixel in each irregular pixel being different from that of a subpixel of the same color in the regular pixel, the display device further comprising a drive circuit for the display panel, wherein the drive circuit is the drive circuit according to claim 4.

6. The display device according to claim 5, wherein the display device is a cellphone.

7. The drive circuit according to claim 4, wherein the display panel includes at least one irregular pixel group, each group has at least two irregular pixels, and between determining the actual light intensities of respective subpixels in each irregular pixel and causing each irregular pixel to display the corresponding actual light intensity, the processor runs the instructions to execute the method further comprising:

detecting, when respective subpixels in respective irregular pixels display according to current actual light intensities, whether a light flux difference between any two irregular pixels in each irregular pixel group exceeds a predetermined value, and if the light flux difference exceeds the predetermined value, adjusting the actual light intensities of respective subpixels of at least one irregular pixel in a same proportion, so that, when respective subpixels in respective irregular pixels display according to the adjusted actual light intensities, the light flux difference between any two irregular pixels in each irregular pixel group is within the predetermined value.

8. The drive circuit according to claim 4, wherein causing the respective subpixels in each irregular pixel to display the corresponding actual light intensities further comprises:

obtaining data voltages corresponding to the actual light intensities of respective subpixels in each irregular pixel, and providing the corresponding data voltages to respective subpixels, to cause respective subpixels to display corresponding actual light intensities.

9. A non-transitory computer-readable storage medium with computer-readable program instructions stored thereon which, when executed by a processor, cause the processor to perform the display method according to claim 1.

* * * * *